US005319696A

United States Patent [19]

Abdel-Malek et al.

[11] Patent Number: 5,319,696

[45] Date of Patent: Jun. 7, 1994

[54] X-RAY DOSE REDUCTION IN PULSED SYSTEMS BY ADAPTIVE X-RAY PULSE ADJUSTMENT

[75] Inventors: Aiman A. Abdel-Malek, Schenectady, N.Y.; Steven P. Roehm, Waukesha, Wis.; John J. Bloomer, Schenectady, N.Y.

[73] Assignee: General Electric Company, Schenectady, N.Y.

[21] Appl. No.: 956,204

[22] Filed: Oct. 5, 1992

[51] Int. Cl.[5] ..... H05G 1/64; H05G 1/32; H05G 1/44

[52] U.S. Cl. ..... 378/108; 378/97; 378/111; 378/112

[58] Field of Search ..... 378/108, 109, 110, 111, 378/112, 96, 97, 99; 358/111

[56] References Cited

U.S. PATENT DOCUMENTS 5,224,141 6/1993 Yassa et al. ..... 378/99

OTHER PUBLICATIONS

U.S. Patent Application "X-Ray Fluoroscopy System for Reducing Dosage Employing Iterative Power Ratio Estimation", Ser. No. RD-21,423 by Richard I. Hartley.

U.S. Patent Application "Fluoroscopic Method With Reduced X-Ray Dosage", Ser. No. 07/810,341 by Fathy F. Yassa, et al. Filed Dec. 9, 1991.

"Imaging Systems for Medical Diagnostics", by Krestel, Aktiengesellschaft, Berlin and Munich, p. 103 no date.

"Medical Imaging Systems" by Macovski, 1983 Prentice-Hall, Englewood Cliffs, N.J. 07632, p. 27.

"Effect of Pulsed Progressive Fluoroscopy on Reduction of Radiatin Dose in the Cardiac Catherization Laboratory", by Holmes, Wondrow, Gray, Vetter, Fellows and Julsrud, Journal. American College of Cardiology, vol. 15, No. 1, pp. 159-162, no date.

*Primary Examiner*—David P. Porta

*Attorney, Agent, or Firm*—Lawrence P. Zale; Marvin Snyder

[57] ABSTRACT

An interactive system for producing acceptable quality fluoroscopy images determines X-ray tube photon count and voltage while minimizing X-ray radiation dosage to a subject. Parameters of the subject and the type of image to be produced are provided to the system. X-ray tube voltage U and photon count Q are initialized at a fraction of conventional values for a portion of a subject to be imaged. An image is created and sectioned into rectangles. Rectangles having the greatest and least gradient values are used to determine variances indicating signal and noise power respectively. Images are produced and adjusted until the maximum transmitted power is reached, or the signal-to-noise ratio does not increase beyond a quality increment. The process is repeated to optimize X-ray tube voltage. The X-ray fluoroscopy procedure is then performed with the optimum X-ray tube photon count and the optimum X-ray tube voltage thereby reducing X-ray dosage. The optimization is repeated periodically to readjust the system.

6 Claims, 6 Drawing Sheets

X-RAY DOSE REDUCTION IN PULSED SYSTEMS BY ADAPTIVE X-RAY PULSE ADJUSTMENT

CROSS REFERENCES TO RELATED APPLICATIONS

This application is related to U.S. Patent application X-Ray *Fluoroscopy System For Reducing Dosage Employing Iterative Power Ratio Estimation Ser. No.* (RD-21,423) by Richard I. Hartley, Aiman A. Abdel-Malek and John J. Bloomer assigned to the present assignee and hereby incorporated by reference.

BACKGROUND OF THE INVENTION

1. Field of the Invention

This invention relates to fluoroscopic imaging and more specifically to reduction in patient X-ray dosage during imaging.

2. Description of Related Art

An X-ray procedure, known as fluoroscopy, creates a series of internal images of a subject. Conventional pulsed systems produce each image by transmitting an X-ray pulse or other ionizing radiation from one side of the subject and detecting the transmitted radiation or shadow at an opposite side of the subject. The intensity of an X-ray radiation beam can be described by the following equation:

$$J=\int J_0(E)e^{-\int \mu(x,E)dx}dE$$

from p. 103 of *Imaging Systems for Medical Diagnostics* by Erich Krestel, Siemans Aktienggesellschaft, Berlin and Munich, where $J_0$ is the intensity of an incident X-ray beam, E is the quantum energy of the X-ray photons, $\mu(x,E)$ is the linear attenuation constant which changes along a direction of the ray x, and changes with photon energy E.

Different tissues exhibit different linear attenuation as a function of X-ray photon energy E, thereby exhibiting different X-ray beam intensities J after transmission through the tissue. Adjusting the X-ray photon energy, therefore, can change the relative X-ray beam intensities as they pass through different tissue types, leading to increased contrast in an image.

The difference in intensity between the incident X-ray radiation, $J_0$ and the transmitted intensity J is proportional to an absorbed dose by the subject being imaged. Compton scattering and photoelectric absorption account for the majority of the energy absorbed by the subject in the spectrum used for conventional X-ray imaging as described on p. 27 of *Medical Imaging Systems* by Albert Macovski, 1983 Prentice-Hall, Engelwood Cliffs, N.J. 07632.

In fluoroscopic systems, the radiation is pulsed at a rate to produce a continuous sequence of images, causing the dosage to become quite large. Fluoroscopy is commonly used in order to correctly position a catheter or similar invasive device inside a subject. Since these procedures may take a long time, the acquired radiation accumulates to a large total dose. A primary goal of diagnostic and interventional X-ray fluoroscopic procedures is to provide an accurate diagnosis while reducing the dose received by the subject and medical staff.

Attempts have been made to reduce dose absorbed by the subject and medical staff during fluoroscopic procedures. These attempts can be classified into three categories:

(1) mechanical redesign of elements of an X-ray system such as the X-ray grid, grid cover, scintillator, table top, cassette front etc. to reduce scattering;

(2) the use of protective gear (e.g., gloves and glasses, although the use of lead gloves hampers the ability to perform the fine movements necessary for catheter placement); and (3) control of X-ray tube parameters.

The control of X-ray tube parameters may be broken down into two methods for reducing the total X-ray dosage. These are:

a) reducing the duration T of each X-ray pulse or the rate at which the source is pulsed; and b) reducing the power transmitted by the X-ray source.

Pulse duration T has been reduced to limit the radiation dose as described in *Effect of Pulsed Progressive Fluoroscopy on Reduction of Radiation Dose in the Cardiac Catheterization Laboratory,* by D. Holmes, M. Wondrow, J. Gray, R. Vetter, J. Fellows, and P. Julsrud, Journal American College of Cardiology, vol. 15, no. 1, pp. 159–162, January 1990 and hereby incorporated by reference. Imaging by reduced pulse rate has the advantage of maintaining the important diagnostic signal at its original high contrast level for a given dosage, but does not collect as many frames. However, the fixed rate reduction methods produce visible jerky motion artifacts. These artifacts may also introduce time delays between a physician's actions and viewed results (e.g., moving a catheter or injecting radio-opaque dye).

A technique for imaging using reduced pulse rates triggered by the subject's organ activity was disclosed in U.S. patent application "Fluoroscopic Method with Reduced X-Ray Dosage" Ser. No. 07/810,341 by Fathy F. Yassa, Aiman A. Abdel-Malek, John J. Bloomer, Chukka Srinivas filed Dec. 9, 1991 assigned to the present assignee and hereby incorporated by reference. Although this technique reduces dosage by reducing the pulse rate, it does not adjust the power transmitted by the X-ray source which may further reduce dose.

Incorrectly reducing the power transmitted by the X-ray source may lead to poor quality images with reduced diagnostic content-the image may be characterized by global graininess and low contrast about important features such as the catheter, balloon, vessel boundaries, etc. Attempts to improve signal to noise ratio via noise reduction filters affect the overall image quality by averaging-out the noise contribution and result in the resultant image quality being of questionable value since the diagnostic information is less exact at lower doses than at higher doses.

The X-ray tube voltage and current necessary to produce a high quality image also depend on the area of the body under study. It is well known that different tissue types attenuate X-rays differently. For example bone is quite dense, requiring high-energy X-ray photons for penetration, while fat, is quite transparent to high-energy photons. Fat requires lower-energy X-rays to retrieve an image with good definition of the embedded features (e.g., contrast).

Since conventional fluoroscopy systems may incorrectly calculate X-ray tube voltage and photon count, subjects may be exposed to more radiation than is necessary, or the images produced may be grainy and lack desired contrast.

Currently, there is a need to accurately determine the required X-ray tube voltage and photon count and produce a high quality image, while also minimizing the X-ray dose to the subject.

SUMMARY OF THE INVENTION

A system for X-ray fluoroscopy imaging of a subject that results in acceptable quality images with reduced radiation dosage to the subject produces images with near optimal X-ray tube photon count and voltage dynamically. The system is initialized with a maximum transmitted power per image $POWER_{max}$ and a fraction, FRAC, such that $0<FRAC\leqq 1$. The system multiplies values from conventional experience curves with the fraction to provide values to create a first image.

The image is low pass filtered (averaged) and decimated, then sectioned into a plurality of rectangles. An average gradient $G\{I(x,y)\}$ approximating a first-order derivative of the image pixel intensities is derived for each rectangle. The rectangle having the greatest average gradient $G\{I(x,y)\}$ is used to determine a signal variance $\sigma_s^2$. The rectangle having the lowest average gradient $G\{I(x,y)\}$ is used to determine a noise variance $\sigma_n^2$. A signal to noise (S/N) ratio is estimated by dividing the signal variance by the noise variance.

An X-ray tube power is calculated, and if below a maximum value, a next image is created. The power ratio for the present image is calculated and compared to a minimum power ratio, and if below this value, another image is created. The power ratio of the newly-created image is analyzed to determine if the image quality is increasing at an acceptable rate. If not, the X-ray tube current is then adjusted. The operator may intervene to adjust the current increment magnitude. Images are thus successively produced and the current adjusted until the image meets a minimum power ratio requirement, the power ratio begins to drop, or the maximum transmitted power per image is reached. The resulting X-ray tube current is the optimum tube current.

The process is repeated to determine the optimum X-ray tube voltage $U_{opt}$ with the photon count set to a value $Q_{opt}$.

Subsequent images for the remainder of the X-ray fluoroscopy procedure are produced using $Q_{opt}$ as the X-ray photon count and $U_{opt}$ as the X-ray tube voltage, thereby reducing the radiation dose the subject. The optimization is repeated periodically to readjust the system.

OBJECTS OF THE INVENTION

It is an object of the present invention to minimize X-ray dose by dynamically adapting X-ray parameters used in X-ray fluoroscopic imaging wherein the images are sectioned into rectangles from which is determined a minimum signal-to-noise ratio based on the ratio of the variance of the rectangle having the highest gradient power signal for the pixels therein to the variance of the rectangle having the lowest gradient power signal for the pixels therein.

It is another object of the invention to provide a method of non-destructive testing of materials which minimizes the amounts of received X-ray radiation.

It is another object of the invention to provide high quality images with a minimum of X-ray radiation wherein the images are sectioned into rectangles from which is determined a minimum signal-to-noise ratio based upon the variances of the rectangles having the most and least noise.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description taken in conjunction with the accompanying drawing in which:

DETAILED DESCRIPTION OF THE INVENTION

The X-ray dose received by a subject is defined by:

$$D=kU^N I_{fil}T$$

where U is the peak X-ray tube voltage in kilovolts, $I_{fil}$ is the X-ray tube filament current in mA, and T is the duration of the X-ray pulse in seconds. X-ray tube filament current $I_{fil}$ is itself an exponential function proportional to Q, a photon count. The number of photons which are emitted is known as the photon count Q. Incremental steps in photon count Q will be small enough to approximate a dose as being linear in the neighborhood of K. The factor "K" depends on the density and geometry of the object being irradiated, tube voltage, geometry of the X-ray system, and the image detector. The exponent "N" increases with decreasing tube voltage. For a typical X-ray source, at 150 KVp N is approximately 3, and as the value of the tube voltage decreases, the value of the exponent increases; thus at 50 KVp it is about 5. The peak tube voltage determines the energy per X-ray photon. The brightness of an image created is proportional to the total photon count Q over an exposure time T. In order to image moving structures, the time of exposure may be reduced from seconds to a few milliseconds. Therefore, the filament current must be increased in order to produce an image of sufficient brightness.

The X-ray tube voltage is based on:

(1) The object to be examined; and (2) contrast range necessary for the diagnosis (for example, an exposure of the "bony thorax" requires 66 KVp in order to diagnose the bone structure, whereas 125 KVp is required if the lung structure is to be diagnosed).

The X-ray tube transmitted power per image (P=U Q) determines, in connection with other system parameters, the spatial resolution of the image.

Figure 1:
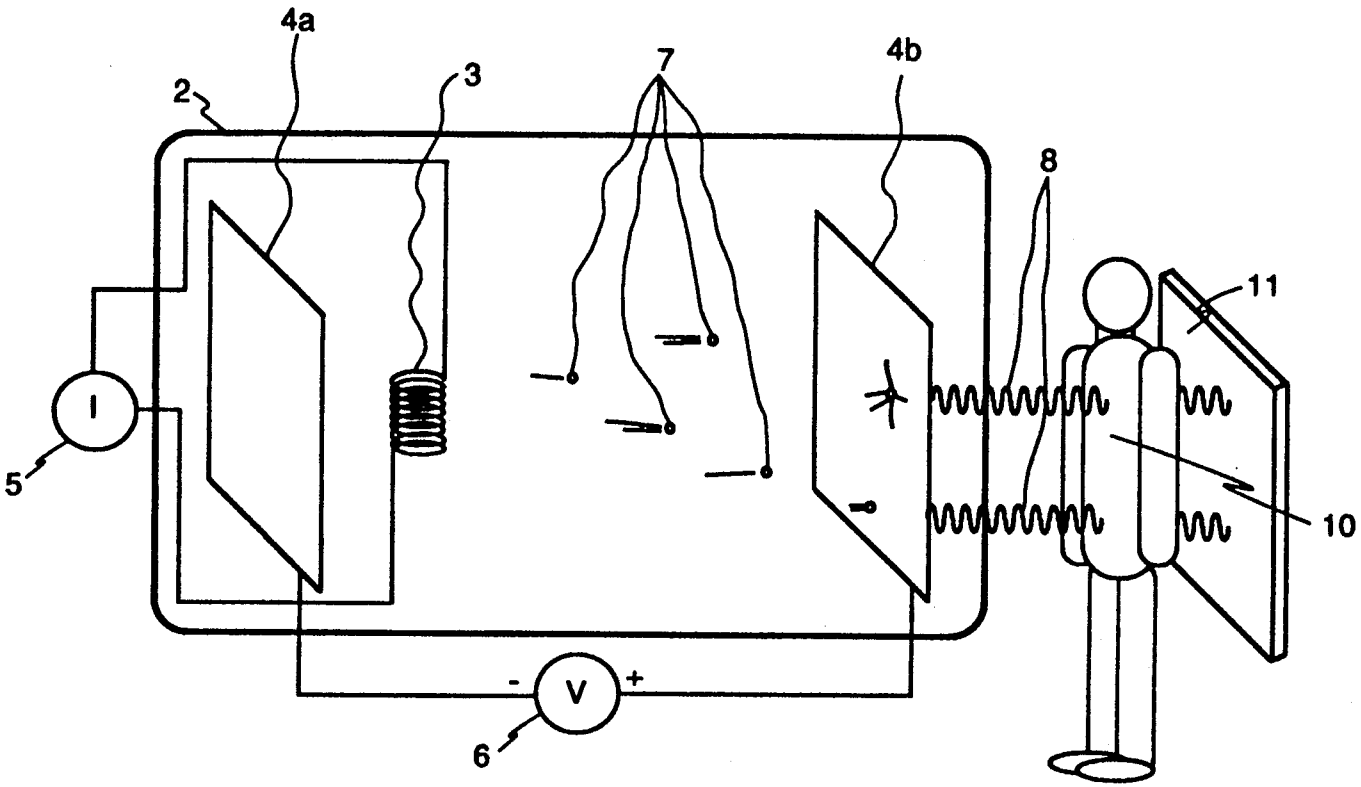
FIG. 1 PRIOR ART
FIG. 1 is a schematic block diagram illustrating operation of a conventional X-ray system.

FIG. 1 illustrates an X-ray tube comprising a coil 3 and a pair of plates 4a and 4b. A current source 5 provides the filament current which passes through coil 3, causing a number of electrons 7 to "boil-off" of coil 3. A voltage source 6 creates a voltage difference between plates 4a and 4b. Electrons 7 are repelled by negatively charged plate 4a to positively charged plate 4b and accelerate at a rate proportional to the voltage difference applied by voltage source 6. Electrons 7 collide with plate 4b and decelerate, causing the kinetic energy of electrons 7 to be translated into electromagnetic photons 8. The energy of each photon, (proportional to the frequency of the electromagnetic radiation), is proportional to the velocity of each electron 7 as it collides with plate 4*b*. The frequency of the electromagnetic radiation is related to its ability to penetrate material objects. The number of electrons 7 which boil off coil 3 are related to the filament current passing through coil 3. Photons 8 emitted from plate 4*b* are directed through a subject 10 to be imaged. Photons which pass through subject 10 are then recorded at a recording plane 11. Recording plane 11 may comprise photographic material which is sensitive to X-rays, or an array which is sensitive to X-rays that is used to capture an image.

The image captured at image plane 11 varies with the voltage of voltage source 6 and a filament current applied through coil 3 from current source 5, since each electron which collides with plate 4*b* creates a photon which passes through subject 10 and illuminates a small portion of image plane 11. The "graininess" of the captured image is related to the photon count Q.

Figure 2:
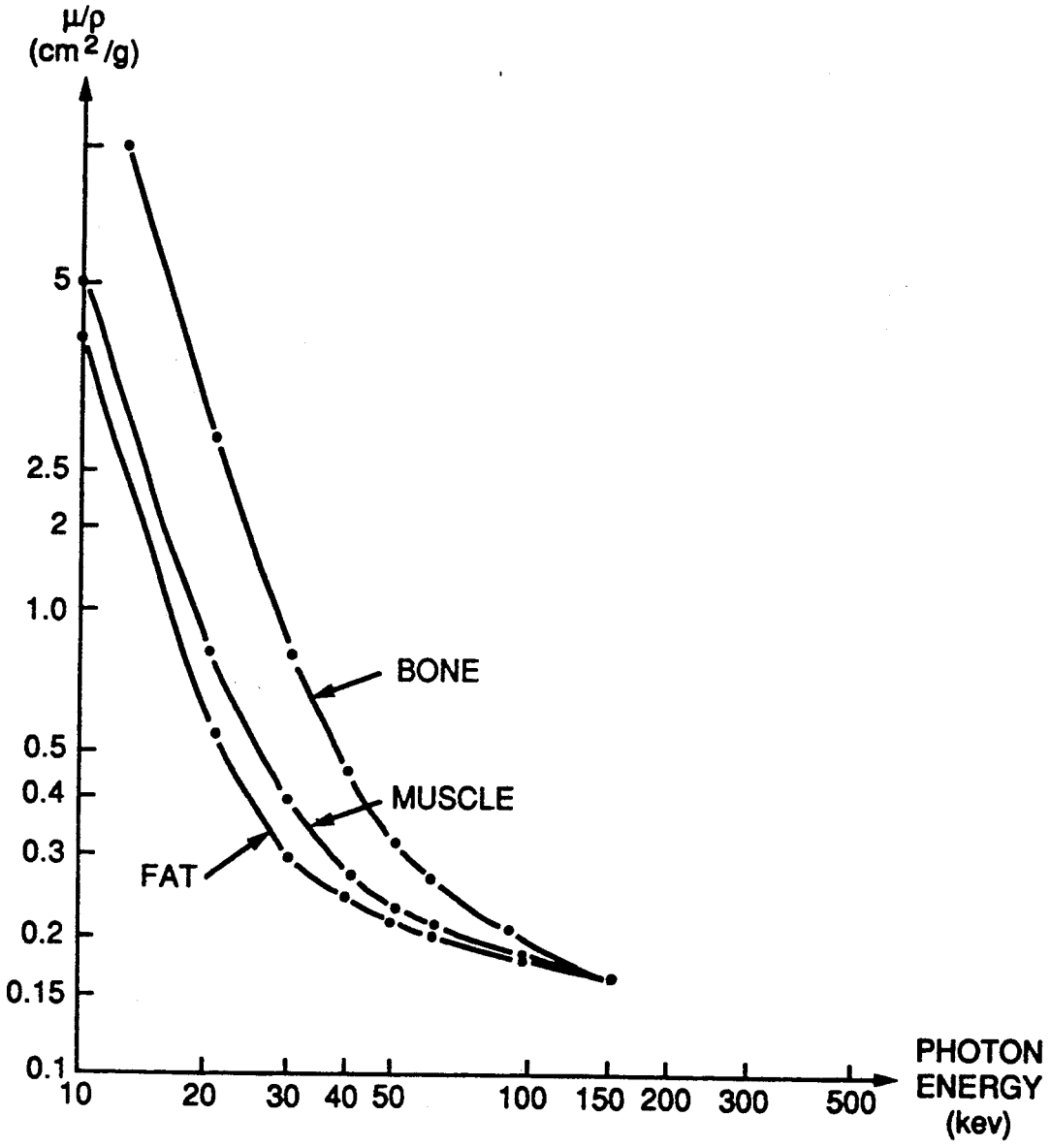
FIG. 2 is a graph of linear X-ray attenuation coefficients vs. X-ray photon energy for muscle, fat and bone

The difference in attenuation of photons 8 passing through different materials of subject 10 varies with photon energy. This difference in attenuation between materials determines the degree of contrast in the created image. In FIG. 2 the linear X-ray attenuation coefficient for muscle, fat and bone are plotted for varying X-ray photon energy. The difference between the curves at any given photon energy level determines the contrast between materials represented by the curves at that photon energy level. Therefore, the contrast of an image acquired at image plane 11 is related to the voltage applied across plates 4*a* and 4*b*.

The dose which subject 10 receives is related to the voltage applied across plate 4*a* and 4*b*, the current passing through coil 3, and the amount of time which radiation is transmitted through subject 10.

Figure 3:
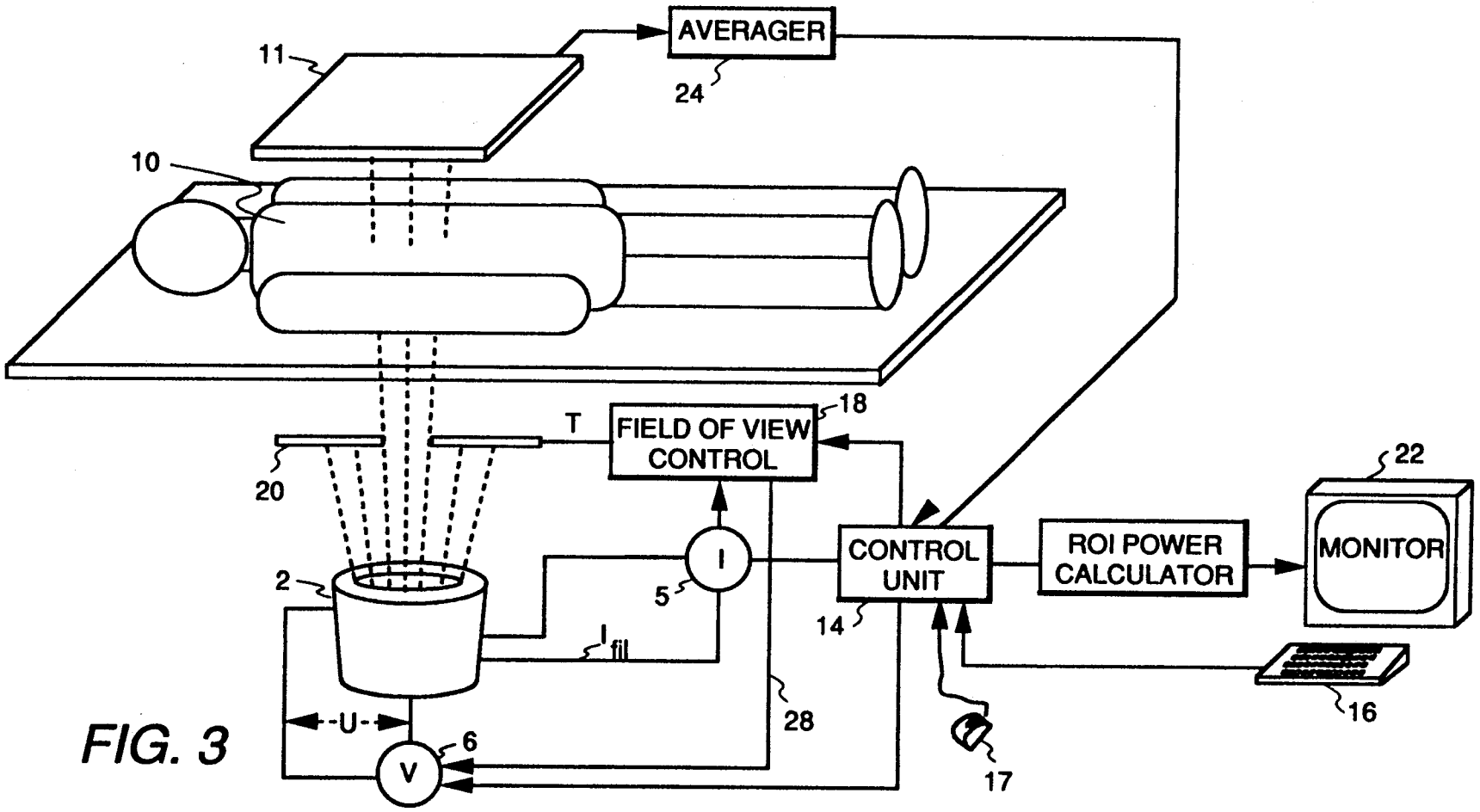
FIG. 3 is block diagram of a fluoroscopy system according to the present invention, in operation on a subject.

In the system of FIG. 3 physical information regarding the tissue or organ of a subject 10 to be imaged is manually provided to control unit 14 through keyboard 16. This information may include the subject's height, weight and other parameters which may affect imaging. The operator may optionally select a minimum acceptable signal to noise ratio $S/N_{min}$ in the produced image. The system is preset with a quality increment indicating a minimum amount of S/N increase per power increase. Control unit 14 establishes initial values for X-ray tube photon count $Q_{init}$ and an X-ray tube voltage $U_{init}$ based upon conventional clinical experience tables for this purpose.

Photon count $Q_{init}$ and voltage $U_{init}$ are multiplied by a predetermined fraction, FRAC, such that $0<\text{FRAC}\leqq 1$, thereby reducing their amplitude to arrive at a photon count Q and voltage U. The resulting amounts are lower than values used in conventional imaging. Control unit 14 furnishes a signal to current source 5 causing it to pass a filament current through X-ray tube 2 corresponding to the desired photon count. Control unit 14 also furnishes a signal to the voltage source 6 causing it to produce a voltage difference across the grid plates of X-ray tube 2. Control unit 14 also furnishes a signal to field of view control unit 18, causing a field of view mask 20 to be opened, allowing X-rays from X-ray tube 2 to pass through subject 10 and to image plane 11. Control unit 14 can be controlled to cause current source 5 to pulse the current, or to control voltage source 6 to pulse the voltage across X-ray tube 2, effectively pulsing X-ray radiation through subject 10. The signal sensed by image plane 11 is passed to an averager 24 which averages the signal over pulse time T for each point of image plane 11 and provides this signal to control unit 14. Control unit 14 constructs an image which is displayed on a monitor 22.

A region of interest (ROI) power calculator 27 low-pass filters the image to reduce the spectral content. ROI calculator 27 then samples the image, decimates the number of samples, and then sections the image into a number of regularly-sized rectangles. A presently preferred embodiment employs a reduced sampled image having 512 by 512 pixels split into 64 rectangles each having 64 by 64 pixels on a side. ROI power calculator 27 then performs a first-order gradient calculation G{I(x,y)} as described in "Digital Image Processing" by Rafael Gonzolez and Paul Wintz, Addison-Wessley Press, Reading, Mass. 1987, p. 176 for each point approximating a derivative operation on each of the rectangles to effectively highlight edges in the image according to the following equation:

$$G\{I(x,y)\}=\nabla_{x,y}I(x,y)=[(i_{x,y}-i_{x+1,y})^2+(i_{x,y}-i_{x,y+1})^2]^{\frac{1}{2}} \tag{2}$$

where x is a location in a horizontal screen direction of the image, y is a location in a vertical screen direction, $i_{x,y}$ is the intensity of the pixel at point x,y of the rectangle, and similarly $i_{x+1,y}$ is the intensity of the next pixel in the x direction with $i_{x,y+1}$ being the next pixel in the y direction. Higher order gradients or further low pass filtering provide a better approximation of the image derivative in the presence of severe noise.

ROI power calculator 27 then computes a gradient power signal $S^2{}_G$ for a rectangle from all pixels within the rectangle according to the following equation:

$$s_G{}^2 = \sum_M \sum_N G\{I(x,y)\}^2 \tag{3}$$

where M, N is the number of pixels in the x and y directions respectively for each rectangle. The gradient power signal is calculated for all rectangles over the image. The rectangle with the maximum gradient power signal $s^2{}_G$ is deemed to be comprised substantially of a signal, defined as a sample signal rectangle, and the rectangle having the lowest gradient power signal $s^2{}_G$ is defined to be comprised of noise, as a sample noise rectangle. The variance of the signal, proportional to signal power, $\sigma^2{}_s$, as described in "Digital Image Processing" by Rafael Gonzolez and Paul Wintz, Addison-Wessley Press, Reading, Mass. 1987, p. 174 is then computed for the sample signal rectangle using the original image pixel values according to the following equation:

$$\sigma_s{}^2 = \frac{1}{MN} \sum_M \sum_N i^2_{x,y} \tag{4a}$$

where $i_{x,y}$ is the intensity of a pixel at point x,y of the sample signal rectangle, M is the number of pixels along a side of the rectangle, and N is the number of pixels along a second side of the rectangle.

To find noise power, ROI power calculator 27 determines the variance $\sigma^2{}_n$ of the sample noise rectangle according to:

$$\sigma_n^2 = \frac{1}{MN} \sum_M \sum_N i_{x,y}^2 \quad (4b)$$

where $i_{x,y}$ is the intensity of a pixel at point x,y of the sample noise rectangle.

The variance calculated for the sample signal rectangle is divided by the variance for the sample noise rectangle to result in an initial S/N ratio:

$$S/N = \sigma_s/\sigma_n. \quad (5)$$

Control unit 14 alters the X-ray tube photon count Q, X-ray tube voltage U, and exposure time T to produce another image on monitor 22. The operator interacts with control unit 14 through monitor 22, keyboard 16, and a pointing device 17 to optionally alter the default rate of change of the X-ray tube voltage and photon count Q. The S/N ratio for the second image is computed as it was for the first image. If the S/N ratio is less than an operator-defined value and the X-ray tube power is less than a maximum exposure, the X-ray tube current is incremented and another image is created. The processing is then repeated. The S/N ratio of the present image is compared to the S/N ratio of the immediately-preceding image. If the S/N ratio does not increase more than the minimal quality increment, adjustment of the photon count Q is complete and processing continues by adjusting the X-ray tube voltage. If the S/N ratio increases more than the minimal quality increment, the photon count Q is adjusted until a calculated S/N ratio increases less than a minimum quality increment, the operator intervenes, or the transmitted power per image reaches a maximum exposure. The current maximum exposure limit for the present embodiment is 10 Rad per minute.

Figure 4A:
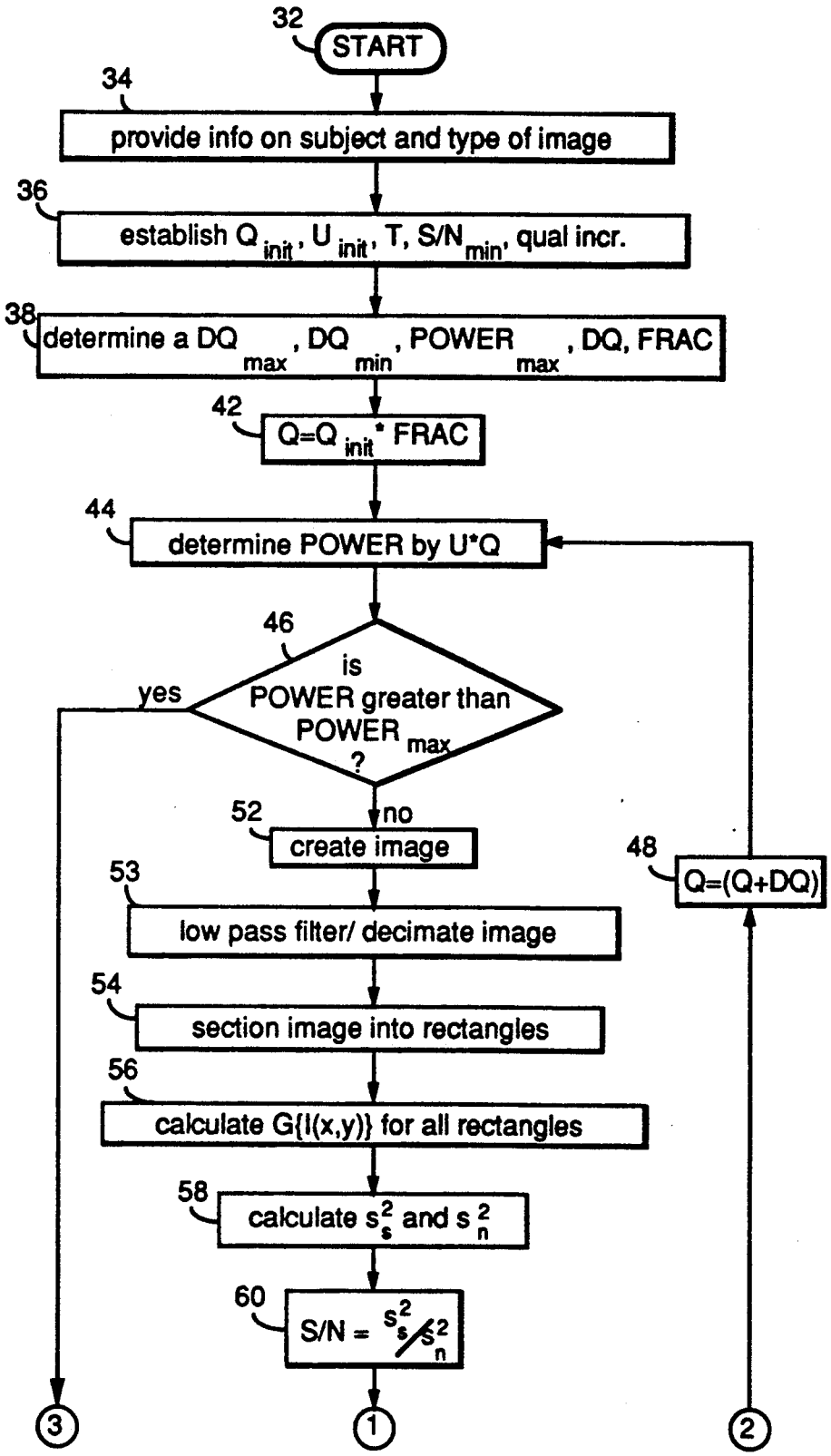
FIGS. 4a, 4b and 4c together are a flow chart illustrating the operation of the present invention.
Figure 4B:
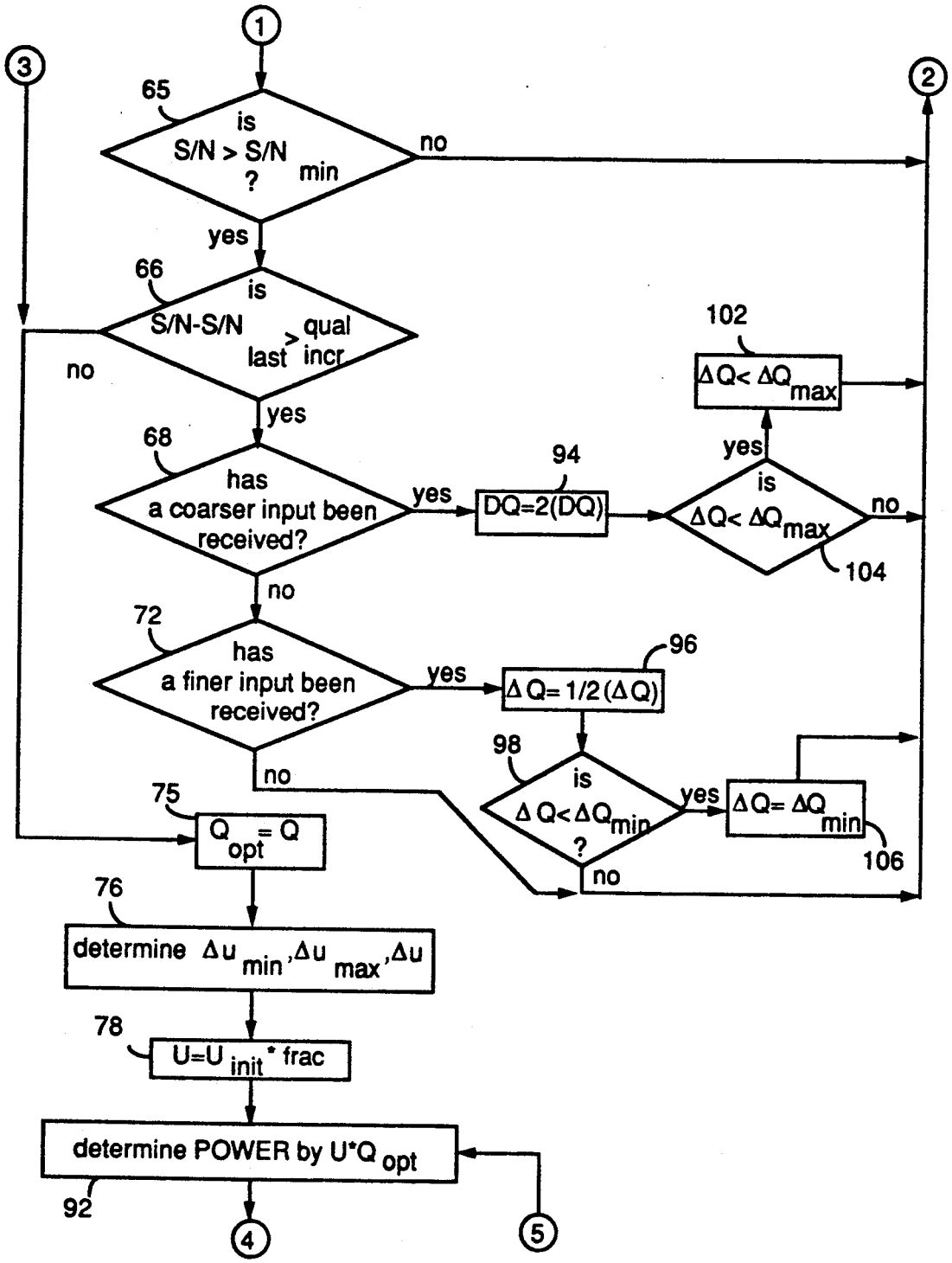
Figure 4C:
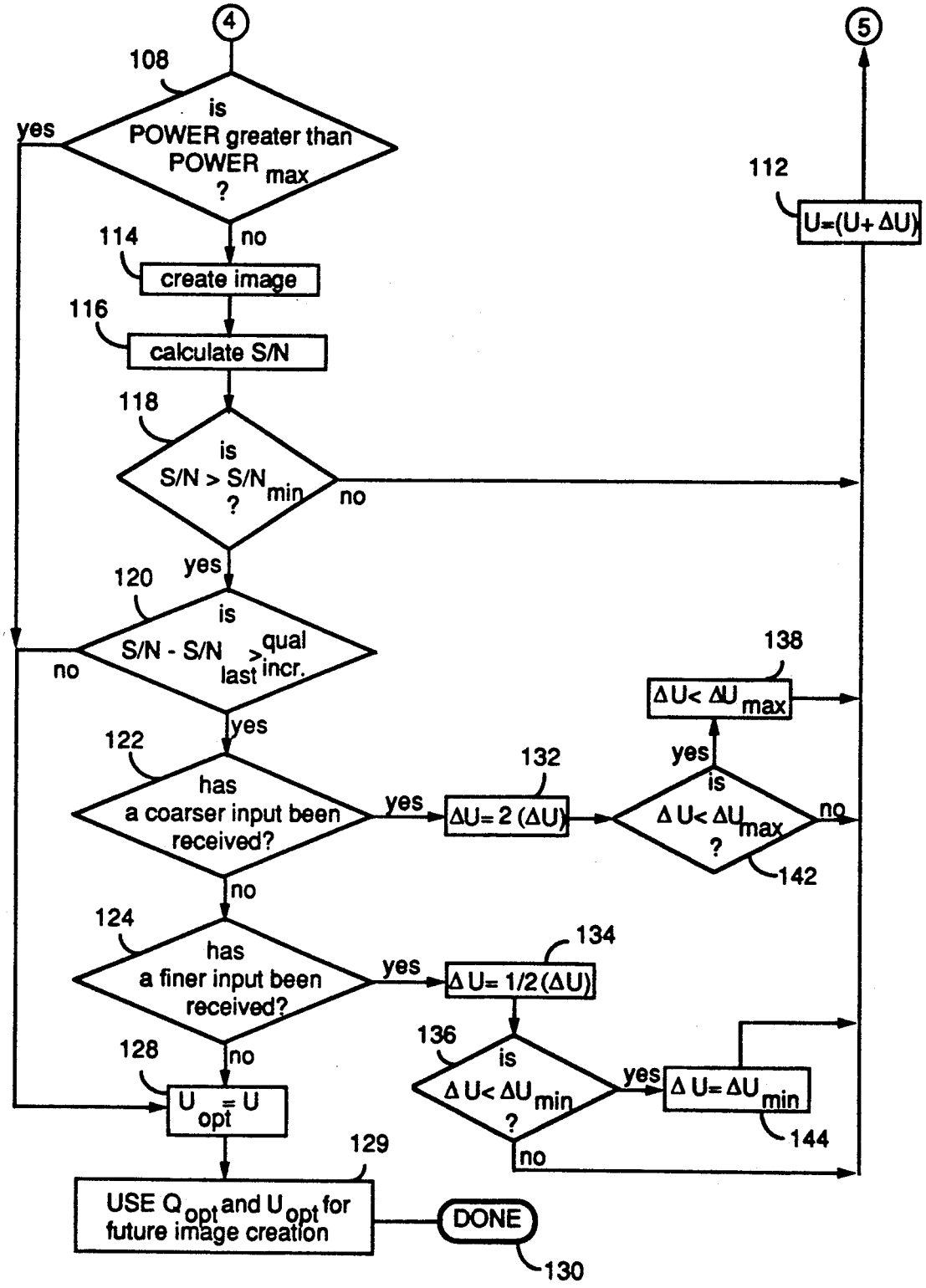

The operation of the present invention, and especially the control unit 14 and ROI power calculator 27 of FIG. 3, may more specifically be described in conjunction with FIGS. 4a, 4b and 4c. Processing begins at step 32 of FIG. 4a. At step 34 of FIG. 4a parameters regarding a portion of the subject's anatomy to be imaged and optionally, the subject's height and weight, are provided to control unit 14 of FIG. 3 with the aid of pointing device 17, keyboard 16 and monitor 22. The operator also may optionally provide a minimum acceptable signal to noise ratio $S/N_{min}$ in the produced image. The system is preset with a quality increment indicating a minimum amount of S/N increase per power increase. The parameters are used to look up in a look-up table in ROI power calculator 27 an initial X-ray tube photon count $Q_{init}$, the X-ray tube voltage $U_{init}$ and the radiation pulse length T. This table is typically a conventional X-ray look-up table, typically based upon well-known clinical standards. At step 38 of FIG. 4a, parameters to be used in the image adjustment, such as $\Delta Q_{max}$, $\Delta Q_{min}$, $POWER_{max}$, $\Delta Q$, and FRAC are set to predetermined values. These parameters are, respectively: the maximum change in X-ray tube currents between images, the minimum change in X-ray tube current between images, the maximum transmitted power for each image, a starting current increment, and a fraction with which to reduce the initial look-up table values.

At step 42 the X-ray tube current is set to the initial photon count $Q_{init}$ which has been provided by the look-up tables multiplied by FRAC, a fraction. In this fashion the photon count Q is made to start below conventional levels.

At step 44 the transmitted power for the image is calculated by P=UQ, and At step 46 a determination is made as to whether if the power is greater than the maximum transmitted power, $POWER_{max}$. If the transmitted power for the next image is below $POWER_{max}$, then the current is incremented at step 48 by the change in current $\Delta Q$ and an image is created at step 52. At step 52 X-rays are transmitted through the subject, received, and an image is created, typically on monitor 22 of FIG. 3. At step 53 the bandwidth of the image is reduced by low pass filtering, sampling and decimation of the number of samples.

At step 54 the ROI power calculator 27 of FIG. 3 sections the image into rectangles. At step 56 ROI power calculator 27 of FIG. 3 calculates a gradient power signal $s^2_G$ for each rectangle according to Equation (3) above. At step 58 the variance of pixels of a rectangle having the greatest gradient power signal $s^2_G$ and the lowest gradient power signal $s^2_G$ are computed to provide an approximation of signal and noise respectively. At step 60 a signal to noise (S/N) ratio for the present image is calculated from the gradient power signals. Processing then continues at step 65 of FIG. 4b. It will be noted that like numbers in FIGS. 4a, 4b and 4c are intended to be connected so as to produce one continuous flowchart among the three figures.

At step 65 of FIG. 4b the S/N of the present image is compared to the $S/N_{min}$ threshold optionally provided by the operator. If $S/N > S/N_{min}$, the image quality is acceptable and processing continues at step 66; if it is not acceptable, the photon count Q is incremented At step 48 and processing continues at step 44 of FIG. 4a.

At step 66, the S/N ratio of the immediately preceding image is subtracted from the S/N ratio of the present image. If this difference is greater than the quality increment, processing continues at step 68. If it is not greater than the quality increment, it is an indication that image quality is falling or not increasing appreciably and processing continues at step 75. At step 68 a determination is made as to whether the operator has indicated that a faster rate of change in tube parameters is required, i.e., a coarser adjustment be made. If the operator has indicated this, the change in currents is doubled At step 94. At step 104 it is determined if the change in photon count $\Delta Q$ is now greater than the maximum allowable change in photon count, and if it is, the change in photon count is set to the upper limit of $\Delta Q_{max}$ and processing continues at step 54 of FIG. 4a. Likewise, if the operator has called for a finer photon count adjustment At step 72, the change in photon count is reduced to half its value At step 96 and compared against the minimum photon count change per image At step 98. If the change in current is less than the minimum change in current allowable per image, the change in current is set to the minimum change in current allowable per image. Processing then continues at step 44 of FIG. 4a.

Steps 76 through the end of the flowchart of FIG. 4c parallel the steps up to this point with the exception of adjusting X-ray tube voltage instead of photon count Q. The optimal photon count $Q_{opt}$ is set to photon count Q at step 75. This optimal current is used in the processing from steps 76 until the end of processing at step 129 of FIG. 4c.

Once the optimal X-ray tube voltage $U_{opt}$ has been determined, the adaptation process may be repeated as required. The adaptation process may be restarted periodically under the control of control unit 14 of FIG. 3. In the present embodiment, the readjustment process is repeated every several seconds. By adjusting the $S/N_{min}$ and quality increment through keyboard 16, pointing device 17 and monitor 22 of FIG. 3, the operator has interactive control over the final image quality.

The type of interaction between the system and the operator may vary. In the example of FIGS. 4*a*, 4*b* and 4*c*, the selections are a "coarser" or "finer" adjustment, along with the ability to set the S/N threshold to affect image quality but alternatively a "brighter/darker toggle" (not shown) may be added to cause the photon count increment $\Delta Q$ to change sign. In either case, the resulting images will have acceptable quality and will be produced while minimizing the X-ray dosage to the subject.

While several presently preferred embodiments of the invention have been described in detail herein, many modifications and variations will now become apparent to those skilled in the art. It is, therefore, to be understood that the appended claims are intended to cover all such modifications and variations as fall within the true spirit of the invention.

What is claimed is:

1. A method of reduced dose X-ray imaging of a subject comprising the steps of:

a) selecting a minimum acceptable signal-to-noise ratio $S/N_{min}$ and maximum transmitted power per image $POWER_{max}$;

b) selecting an X-ray tube voltage U within an acceptable X-ray tube voltage range and a pulse duration T;

c) selecting a photon count Q less than a maximum allowable photon count $Q_{max}$ consistent with limiting the subject's dose to an acceptable level;

d) determining transmitted power per image, and if it exceeds $POWER_{max}$, then continuing at step "o";

e) transmitting X-ray radiation through said subject by applying the X-ray tube voltage U, and a current corresponding to photon count Q to an X-ray tube;

f) sensing the X-ray radiation which was transmitted through said subject;

g) constructing an X-ray image of said subject from the sensed X-ray radiation;

h) sectioning the X-ray image into rectangles each comprised of a plurality of pixels;

i) calculating a gradient G{i(x,y)} for each rectangle;

j) choosing the rectangle having the greatest gradient G{i(x,y)} as the sample signal rectangle, and the rectangle having the lowest gradient G{i(x,y)} as a sample noise rectangle;

k) calculating a variance $\sigma_s^2$ from the pixels of the rectangle having the greatest gradient G{i(x,y)} and a variance $\sigma_n^2$ from the pixels of the rectangle having the lowest gradient G{i(x,y)};

l) calculating a signal to noise ratio for the present image according to the following equation:

$$S/N=\sigma_s^2/\sigma_n^2;$$

m) computing an X-ray does received by the subject for the image;

n) repeating steps "c"–"m" for differing values of Q if a difference between the calculated S/N ratio of the present image and that of an immediately preceding image exceeds a predetermined quality increment;

o) repeating steps "c"–"n" for several selected X-ray tube voltages U;

p) producing subsequent X-ray images with one of the selected X-ray tube voltages U and Q producing a minimum X-ray dose for said subject while creating an image with a signal-to-noise ratio greater than $S/N_{min}$.

2. The method of reduced dose X-ray imaging as recited in claim 1 wherein the gradient G{i(x,y)} is calculated according to the following equation:

$$G\{I(x,y)\}=\nabla_{x,y}I(x,y)=[(i_{x,y-x+1,y})2+(i_{x,y-x-,y+1})^2]^{\frac{1}{2}}$$

where x is a location of the image in a horizontal screen direction of the image, y is a location of the image in a vertical screen direction, $i_{x,y}$ is the intensity of a pixel at point x,y of the rectangle, and $i_{x+1,y}$ is the intensity of a next pixel in the x direction with $i_{x,y+1}$ being a next pixel in the y direction.

3. The method of reduced dose X-ray imaging as recited in claim 1 wherein the variances $\sigma_s^2$ and $\sigma_n^2$ are calculated according to the following equations:

$$\sigma_s^2 = \frac{1}{MN} \sum_M \sum_N i_{x,y}^2$$

where $i_{x,y}$ is the intensity of a pixel at point x,y of the sample signal rectangle, M is the number of pixels along a side of the rectangle, and N is the number of pixels along a second side of the rectangle, and $$\sigma_n^2 = \frac{1}{MN} \sum_M \sum_N i_{x,y}^2,$$

where $i_{x,y}$ is the intensity of a pixel at point x,y of the sample noise rectangle.

4. The method of reduced dose X-ray imaging of a subject of claim 1 further comprising, before the step of sectioning the image into rectangles, the steps of:

a) sampling the image;

b) low pass filtering the image; and c) decimating the number of samples of the image.

5. The method of reduced dose X-ray imaging as recited in claim 1 wherein the minimum acceptable signal-to-noise ratio $S/N_{min}$ and the X-ray tube voltage range are set manually by an operator.

6. The method of reduced dose X-ray imaging as recited in claim 1 including, before step "c", the step of obtaining a maximum allowable photon count $Q_{max}$ from a look-up table.

* * * * *

UNITED STATES PATENT AND TRADEMARK OFFICE

CERTIFICATE OF CORRECTION

PATENT NO. : 5,319,696

DATED : June 7, 1994

INVENTOR(S) : Abdel-Malek, Roehm, Bloomer (Yassa)

It is certified that error appears in the above-indentified patent and that said Letters Patent is hereby corrected as shown below:

On the title page, after "Inventors:", please add "Fathy F. Yassa, Puteaux, France" as the last inventor along with his city of residence.

Signed and Sealed this

Twenty-fifth Day of October, 1994

*Attest:*

*Attesting Officer*

Bruce Lehman

BRUCE LEHMAN

*Commissioner of Patents and Trademarks*